United States Patent [19]

Best

[11] Patent Number: 4,575,710

[45] Date of Patent: Mar. 11, 1986

[54] AUTOMATIC TESTING SYSTEM ELECTRICAL TRANSMITTERS

[75] Inventor: Martin F. Best, Charlotte, N.C.

[73] Assignee: Duke Power Company, Charlotte, N.C.

[21] Appl. No.: 493,050

[22] Filed: May 9, 1983

[51] Int. Cl.[4] ..... G08B 29/00; G08B 26/00

[52] U.S. Cl. ..... 340/514; 340/505; 340/518; 340/525; 340/538; 340/310 R

[58] Field of Search ..... 340/514, 518, 505, 524, 340/525, 531, 538, 310 R, 533, 534, 516, 825.17, 825.06–825.14, 825.54; 455/14–16; 375/3, 4, 36; 179/170 J; 178/70 R, 70 TS

[56] References Cited

U.S. PATENT DOCUMENTS

| | | | |
|---|---|---|---|
| 3,516,063 | 6/1970 | Arkin et al. | 340/825.1 |
| 3,634,824 | 1/1972 | Zinn et al. | 340/825.17 |
| 3,735,396 | 5/1973 | Getchell | 340/518 |
| 3,806,872 | 4/1974 | Odom | 340/518 |
| 3,927,404 | 12/1975 | Cooper | 340/518 |

OTHER PUBLICATIONS

"Programmable Power Line Carrier Blocking Relay Channel", F. T. Shannon, Mar., 1981; G.E. Pub.

"Power Line Carrier Teleprotection Channel Equipment", G.E. Publication, 1980.

*Primary Examiner*—Donnie L. Crosland

*Attorney, Agent, or Firm*—Shefte, Pinckney & Sawyer

[57] ABSTRACT

An automatic testing system for testing the operability of transmission line carrier units using timers that periodically activate a signal for energizing local carrier unit transmitters with a delayed energization of local carrier unit receivers, and a signal stepping circuit that connects the transmitter and receiver signal sequentially to the carrier units in a series of transmission lines. The absence of a signal being received by the local carrier unit receiver indicating a fault that is detected in latches that provide an indication of the carrier in which the fault has occurred and an indication at a remote computer when there has been at least one failure in the testing sequence, which failure indication remains activated at the end of a testing sequence to assure attention by the operator. The sequencing occurs automatically with a capacitor-delayed spike signal that provides sufficient time for the indication of the absence of a signal without requiring separate circuitry.

4 Claims, 2 Drawing Figures

AUTOMATIC TESTING SYSTEM ELECTRICAL TRANSMITTERS

BACKGROUND OF THE INVENTION

The present invention relates to an automatic testing system for electrical transmitters, and more particularly, to such a system for testing a series of remote, normally quiescent, electrical transmitters.

In various electrical applicaitons, auxiliary systems are incorporated for indicating failure of the primary electrical function, which auxiliary systems are normally quiescent and are activated only when the primary function fails to perform properly. Because they are normally quiescent, it is necessary to periodically check their operability to be sure that they are in condition to respond to a primary function failure.

For example, in the transmission of electrical power the transmission lines are monitored for failures by a power line carrier relay system that has coordinated relays at the ends of sections of the line to mutually respond to power failure or shorting in any of the sections by energization of radio transmitter/receiver units associated with the relays that respond to power line failures occurring between the relays. However, as the carrier system is normally quiescent, it is necessary to periodically test the operability of the system, which testing is conventionally accomplished by manual actuation of local transmitter/receiver units individually at a substation to transmit signals to remote transmitter/-receiver units that are energized by the signals to transmit signals back to the local transmitter/receiver units. If no signal is received by a local transmitter/receiver unit when it is being tested, it is an indication that the units are not operational and repair or replacement is required. These known carrier testing units function to individually test each transmission line carrier with a separate testing unit needed for each line, which may be multiple terminal lines, but are not capable of testing in sequence a series of transmission line carriers with a single testing unit at a common substation nor in a manner that sequences through the series of transmission line carriers and provides an indication whether any transmission line carriers in the set have failed and maintains an indication of which carrier or carriers have failed so that repairs can be made expeditiously.

SUMMARY OF THE INVENTION

The present invention improves the state of the art by providing a system for automatically testing the operability of a series of remote, normally quiescent, electrically operable transmitters, such as transmission line carrier transmitter/receiver units, in an automatic sequence that provides for automatic stepping of the system through testing of each transmitter in the series without requiring a testing device for each transmitter and in a manner that functions effectively to provide intelligent and usable information regarding the operability status of the units being tested.

Briefly described, the testing system of the present invention tests the operability of a series of remote, normally quiescent, electrically operable transmitters, each of which operates to transmit an electrical signal for a predetermined period of time in response to receipt of an electrical activating signal transmitted by a local transmitter associated with each remote transmitter with the remote transmitter receiving the signal from the local transmitter. The system includes means for actuating the local transmitter and local means associated with each local transmitter actuating means for indicating the absence of receipt by the local receiver of a transmission from the associated remote transmitter. Stepping means are included for sequentially enabling the local transmitter actuating means and associated indicating means, and means are provided for repetitively applying periodic actuating signals to the local transmitter actuating means to effect with the stepping enabling means actuation of each local transmitter sequentially for transmission of a signal to the associated remote transmitter to cause the remote transmitter to transmit a signal for receipt by the associated local receiver. Each transmission absence indicating means, when enabled by the stepping means, is responsive to its associated local receiver to provide an indication of the absence of receipt of a remote transmission from the associated remote transmitter.

Preferably, the transmission absence indicating means maintains the indication throughout subsequent testing of other remote transmitters and until the system is deenergized or the testing is repeated, thereby providing an indication at the end of the testing sequence of a specific remote transmitter from which no transmission was received, and further means are provided responsive to all of the transmission absence indicating means to provide a continuing indication when no transmission has been received from at least one of the remote transmitters tested during the testing sequence. In addition, means are provided for de-energizing the system upon completion of the testing sequence with other means responsive to all of the transmission absence indicating means to prevent operation of the system de-energizing means in response to the absence of a transmission being received from any of the remote transmitters tested during the testing sequence.

The aforementioned periodic actuating signal applying means preferably terminates each periodic signal prior to each sequential stepping by the stepping enabling means for termination of transmission by each local transmitter prior to termination of response by the transmission absence indicating means, thereby avoiding interference by transmissions from the local transmitter with reception by the local receivers. The transmission absence indicating means is combined with means for delaying the enabling of such transmission absence indicating means for a period of time after termination of transmission by the associated local transmitter to further assure the absence of interference.

The periodic actuating signal applying means preferably applies the signal to the stepping enabling means to effect stepping at the initiation of each periodic signal and applies the periodic signal to the transmission absence indicating means to prevent actuation of the transmission absence indicating means during application of the periodic signal.

In the preferred embodiment, means are provided for repetitively applying periodic deactuating signals to the transmission absence indicating means to prevent actuation of the transmission absence indicating means during the periodic deactuating signals and each deactuating signal is applied during application of a corresponding periodic actuating signal and for a period of time thereby beyond to prevent actuation of the transmission absence indicating means during transmission of the local transmitter. The periodic actuating signal applying means applies the signal to the stepping enabling means to effect stepping at the initiation of each periodic signal and is responsive to the deactuating signals to apply the actuating signal to effect stepping in response to termination of each deactuating signal, with additional means delaying the response of the actuating signal applying means to termination of each deactuation signal sufficiently to permit the transmission absence indicating means to provide an indication prior to stepping by the stepping enabling means. Further, means are provided responsive to termination of application of each deactuating signal and operable to cause the deactuating signal applying means to initiate application of a subsequent deactuating signal, with delaying means included to delay the initiation of deactuating signals sufficiently to permit the transmission absence indicating means to provide an indication subsequent to termination of a deactuating signal and prior to initiation of a subsequent deactuating signal. This delaying means also provides sufficient delay to permit the transmission absence indicating means to provide an indication prior to stepping by the stepping enabling means.

With this arrangement, an automatic and inherently operable system is provided that reliably and expeditiously produces an indication of the operating condition of remote transmitters with a relatively simplified and integrally responsive combination of components.

DETAILED DESCRIPTION OF THE PREFERRED EMBODIMENT

Figure 1:
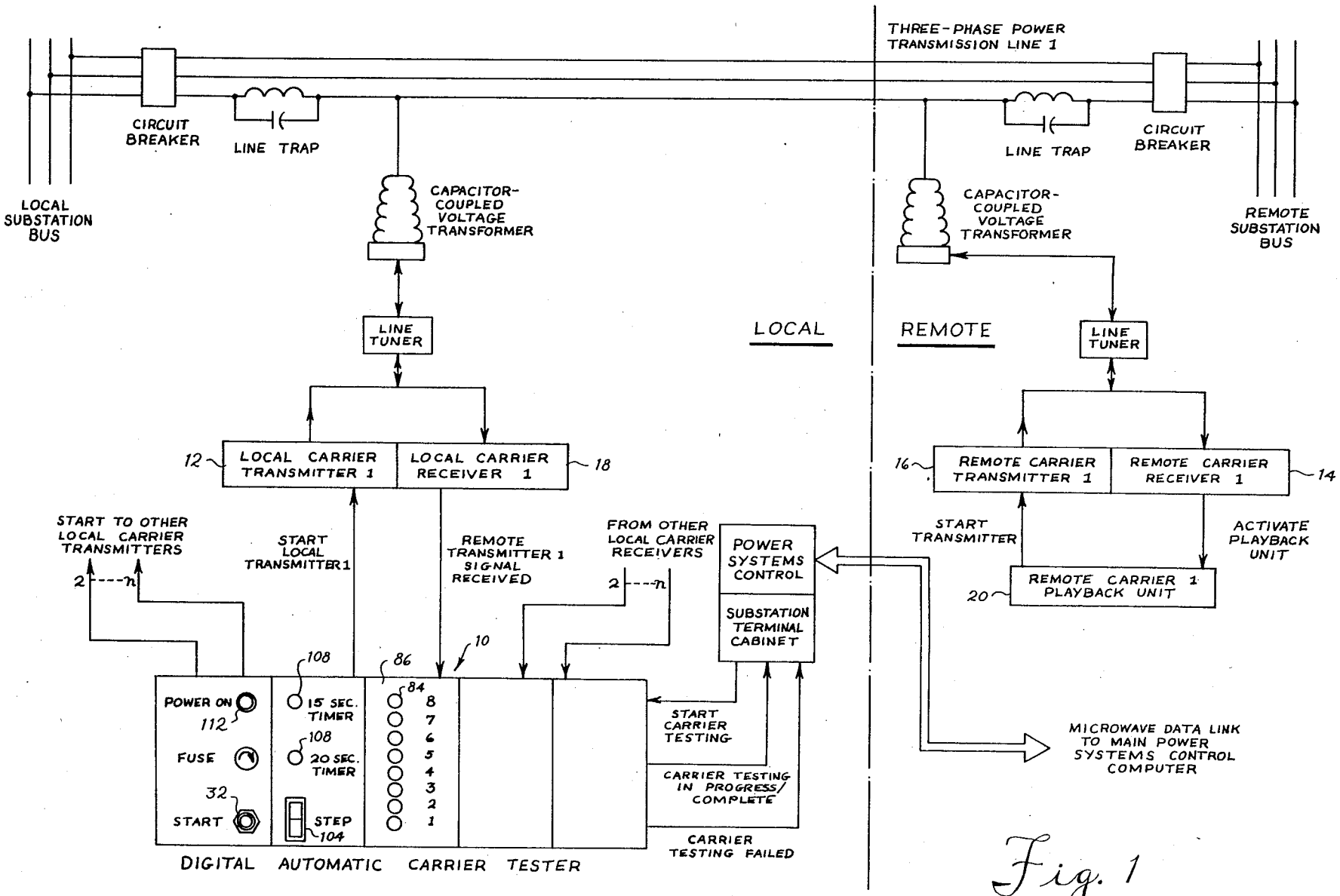
FIG. 1 is a diagramatic illustration of the testing system of the preferred embodiment of the present invention incorporated in an electrical transmission line for testing of the power line carrier relay system thereof.
Figure 2:
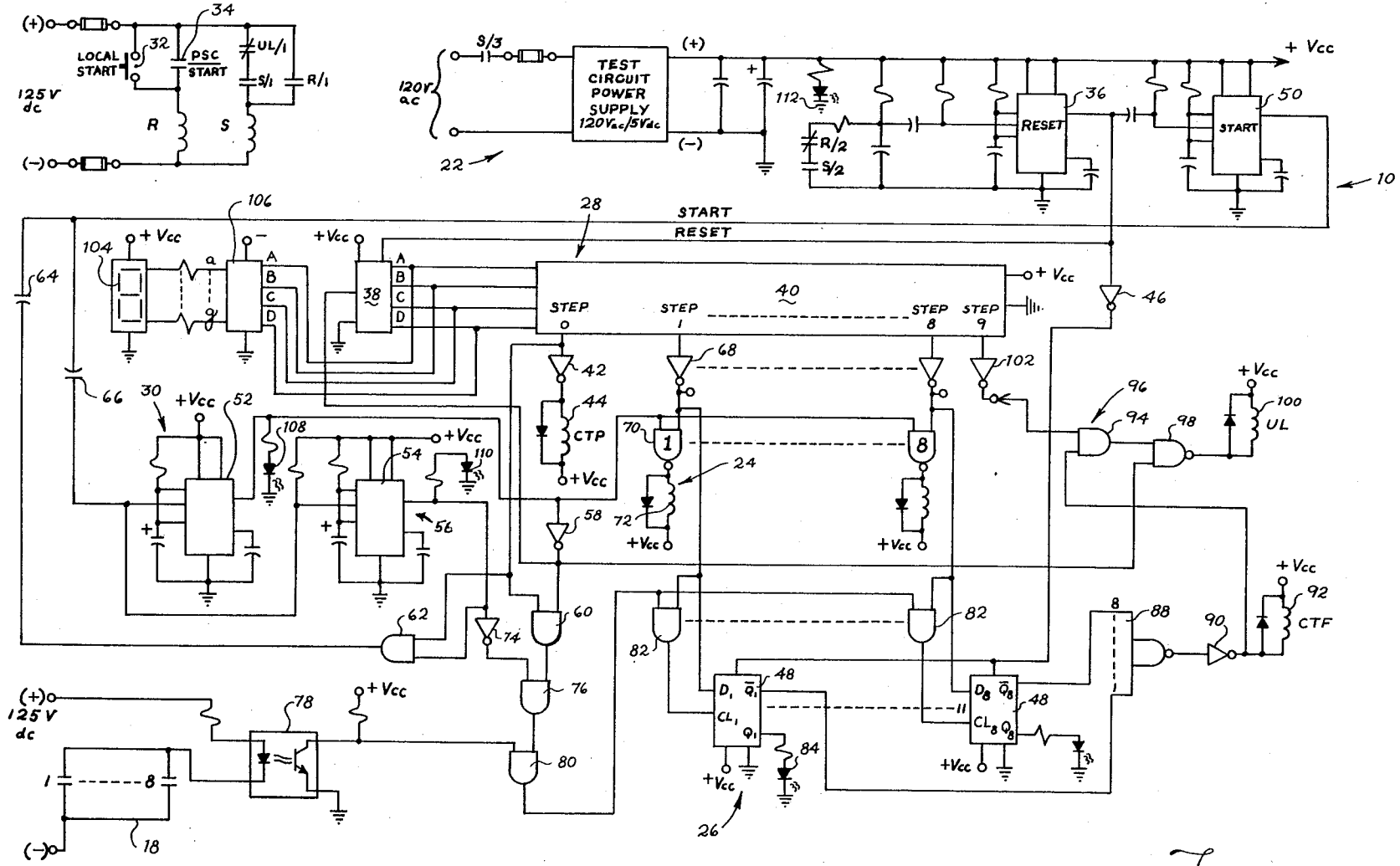
FIG. 2 is a schematic wiring diagram of the testing system of the preferred embodiment of the present invention.

The testing system 10 of the present invention is illustrated in its preferred embodiment in FIGS. 1 and 2 associated with transmitter/receiver units in association with an electrical transmission line. These transmitter/-receiver units are referred to in the trade as carriers and are used for the transmission and reception of carrier current high speed signals over high voltage power lines for directional comparison pilot relaying and supervisory control using electro-mechanical relays. As illustrated in FIG. 1, such a transmission line is illustrated as a three-phase power transmission line having circuit breakers at both the local substation bus and the remote substation bus and operable in association with the carrier units to shut down the line between the substations when a short or other failure occurs, with the carrier units further providing an alarm to alert the operating personnel of the problem. In the line of FIG. 1, which would be one of a number of lines serviced from a local substation, a failure in the line would cause the supervisory protective relays (not shown) at each end of the line to determine the location of the failure. If the failure is between the local and remote carriers, the local protective relays (not shown) will cause the local carrier transmitter 12 of the transmitter/receiver unit to initiate a signal through the line tuner and the capacitor-coupled voltage transformer to the line that carries the signal, across line traps that maintain the signal and block out other signals, to the remote substation at which it passes through another capacitor-coupled voltage transformer and line tuner to a remote carrier receiver 14. Similarly, if the transmission line failure is between the local and remote carriers, the remote protective relays (not shown) will cause the remote carrier transmitter 16 to send a signal to the local carrier receiver 18. Having determined the location of the line failure, the protective relays then shut down the local and remote carrier transmitters. Shutting down the carrier transmitters sets the carrier receivers up to permit the protective relays to simultaneously open the circuit breakers at each end of the transmission line.

If the protective relays had determined that the line failure was on some other transmission line than the one shown in FIG. 1, the carrier transmitter on one end of the line would have started but the carrier transmitter on the other end of the transmission line would have remained off. In this case, neither circuit breaker will be opened, because the carrier receiver on one end will not permit the protective relays to open their circuit breaker and the protective relays on the other end will not operate to open their circuit breaker. This carrier system as described to this point is conventional and need not be described in further detail.

Because the carrier units 12,18 and 14,16 are normally quiescent, it is necessary to periodically test them to be sure they are operable and ready to respond to indicate when a short or fault has occurred in the line. Periodic testing is accomplished by initiating only the local carrier transmitter. During a test, initiation of the local carrier transmitter 12 causes a signal to be sent through the line tuners and capacitor-coupled voltage transformers to the remote carrier receiver 14. Since the carrier transmitter in on much longer for a periodic test than it is for a transmisssion line failure, the remote carrier receiver 14 is able to activate the remote carrier playback unit 20. When the local carrier transmitter 12 is shut down, the remote carrier receiver 14 initiates the remote carrier transmitter 16 through the remote carrier playback unit 20. The remote carrier transmitter 16 then sends a signal through the line tuners and capacitor-coupled voltage transformers to the local carrier receiver 18. The operability of the carrier system is usually determined by monitoring carrier signal strength as indicated by meters on the local carrier transmitter/receiver during periodic testing. In the past, periodic testing of carrier transmitter/receivers has been done using a checkback monitor system requiring travel of an operator to the substation and manual initiation of testing of each carrier separately at considerable time and cost of testing. By the present invention, as will now be described, the entire testing sequence can be initiated by a main power control computer and will automatically sequence through testing of all the carriers to provide an indication of a failure in the sequence and maintenance at the substation of an indication of which carrier has failed, which indication is maintained until the failure has been corrected. As seen in FIG. 1, a microwave data link to the main power system's control computer allows the testing system to be initiated by powering the system's control at a substation terminal cabinet, which then starts the carrier testing. The system then provides a signal back through the power system's control to the computer indicating that carrier testing is in progress. The testing system identified in FIG. 1 is a digital automatic carrier tester that can also be started by pressing a start button at the substation. In either event, starting of the system deactivates the conventional alarm system (not shown) and initiates sequential actuation of the local carrier transmitters with the tester indicating that the timers to be described later are timing and indicating on the tester panel which carrier is being tested by and LED at a "STEP" window. The remote carrier transmitter of the line being tested responds, if it is operable, or does not respond, if it is not operable. If it responds, the testing system automatically steps sequentially to the next transmission line and repeats the testing procedure. If no signal is received from the remote carrier, the testing system sends a signal back to the substation terminal cabinet to the computer indicating a failure in the testing, which signal is maintained throughout the remainder of the testing and until the carrier failure has been corrected. Also, the testing system lights a light to indicate which carrier has failed so that a repairman will be able to tell which carrier has failed. When testing of all of the carriers in the sequence has been completed, the testing system sends a signal back through the substation terminal cabinet to the computer to indicate that testing has been completed. If no carriers in the sequence failed, the testing system automatically shuts down, but if a carrier failed, the system remains energized until repair has been made and a successful testing sequence has been conducted or until the system is manually shut down.

The specific details of the testing system 10 of the present invention is illustrated in FIG. 2. Basically, the system 10 includes a power-up circuit 22, means 24 for actuating each local carrier transmitter, local means 26 associated with each local transmitter actuating means for indicating the absence of receipt by the local receiver 18 of a transmission from the associated remote transmitter 16 (FIG. 1), stepping means 28 for sequentially enabling each local transmitter actuating means 24 and associated indicating means 26, means 30 repetitively applying periodic actuating signals to the local transmitter actuating means 24 to effect with the stepping enabling means 28 actuation of each local transmitter sequentially for transmission of a signal to the associated remote transmitter to cause the remote transmitter to transmit a signal for receipt by the associated local receiver. Each transmission absence indicating means 26 when enabled by the stepping means 28 is responsive to its associated local receiver to provide an indication of the absence of receipt of a remote transmission from the associated remote transmitter.

When the power-up circuit 22 is actuated manually by closing the local start button 32 or automatically by the computer through a PSC start switch 34, a relay R is energized and closes contact R/1, causing energization of relay S, thereby closing contact S/1 to maintain power on after the start switches are opened. Relay R also opens contact R/2 during the temporary closing of the start switches, which allows the power supply time to power up after contact S/3 closes upon energization of relay S. Relay S also closes contact S/2 so that when contact R/2 drops to closed position, power will be applied to a reset timer 36, which emits a pulse signal of about 20 milliseconds. While the pulse from reset timer 36 is high, it causes a decade counter 38 to reset to STEP 0 a BCD to decimal decoder 40 that is part of the stepping enabling means 28. At STEP 0, the decoder 40 emits a low signal that is inverted by the inverter 42 to a high signal that does not actuate a CTP relay 44 that indicates that a test is in progress when it is energized. The pulse from the reset timer 36 also passes through an inverter 46 and is applied to a series of latches 48 to reset them not to indicate a failure. In this condition, the testing system 10 is prepared to proceed with the testing sequence.

The power-up circuit 22 also includes a start timer 50 that times out after the reset timer 36 and goes from high to low to energize a first timer 52 and a second timer 54. The first timer 52 is the primary component of the periodic actuating signal applying means 30 and has a timing period of, for example, 15 seconds. The second timer 54 is a primary component of means 56 for delaying the enabling of each transmission absence indicating means 26 for a period of time after termination of transmission by the associated local transmitter 12 (FIG. 1). This second timer 54 has a period longer than that of the first timer 52, which may be, for example, 20 seconds.

The output of the first timer 52 during its timing period goes from low to high and is inverted by inverter 58 and applied to the counter 38, which in turn, causes the stepping decoder 40 to step. Stepping from STEP 0 changes the output of STEP 0 from low to high, which is inverted by inverter 42 to low, which low signal is applied to the relay 44, which acts to provide a signal to the computer to indicate that a test is in progress and also disconnects the station carrier alarm (not shown). This signal is maintained until the system is shut down at the end of a testing sequence or until the system again steps to STEP 0.

The high output from STEP 0 after the decoder 40 has stepped from STEP 0 also is applied to an AND gate that leads to the signal absence indicating means 26 so that when the stepping decoder 40 is at STEP 0 the low output will prevent any operating signal to reach the signal absence indicating means 26, but when the decoder 40 has stepped off STEP 0 the high signal will allow other components of the system to control operation of the signal absence indicating means 26. The output from STEP 0 further is applied to another AND gate 62 that is connected to the periodic actuating signal applying means 30 so that when the decoder 40 is on STEP 0 the low output will be applied to this AND gate 62 and prevent actuation of the periodic actuating signal applying means 30 but when the decoder 40 has stepped away from STEP 0 the high signal to AND gate 62 will allow the output from the second timer 54 to control actuation of the periodic actuating signal applying means 30 through connection also to this AND gate 62. When the second timer 54 times out, its output applied to AND gate 62 will drop from high to low and the output from AND gate 62 will drop from high to low, creating delayed spikes through capacitors 64 and 66 that create delay in passage of the signal to the first and second timers 52 and 54, which upon receipt of this delayed signal causes stepping of the decoder 40 by the output of the first timer 52 through the inverter 58 and counter 38. Thus, the periodic actuating signal applying means 30 serves to apply the signal to the stepping enabling means 28 to effect stepping at the initiation of each periodic signal, and the capacitors 64,66 serve as means delaying the response of the actuating signal applying means 30 to termination of each deactuating signal sufficiently to permit the transmission absence indicating means 26 to provide an indication prior to stepping by the stepping enabling means 28. Further, the AND gate 62 and capacitors 64,66 serve as means responsive to termination of application of each deactuating signal and operable to cause the deactuating signal applying means to initiate application of a subsequent deactuating signal, and provide means delaying the initiation of the deactuating signals sufficiently to permit the transmission absence indicating means to provide an indication subsequent to termination of a deactuating signal and prior to initiation of a subsequent deactuating signal and prior to stepping by the stepping enabling means.

The output from STEP 1 and from each subsequent step through STEP 8, goes from high to low when the decoder 40 steps to that particular step and this low signal is inverted by an inverter 68 to a high signal that is applied to a NAND gate 70, the other input to which is from the first timer 52, which when the timer is timing applies a high signal to NAND gate 70 resulting in a low output from the gate, which is applied to a relay 72 that is the primary component of the local carrier transmitter actuating means 24. When this relay 72 is receiving the low output from NAND gate 70, it energizes the local transmitter 12 (FIG. 1) to send a signal to the corresponding remote receiver 14 (FIG. 1). Thus, as the testing system steps through the sequence of steps, each local transmitter is periodically actuated in sequence.

The high signal output from the first timer 52 during the timing period is also applied through the inverter 58 as a low signal to the AND gate 60 so that a low output will be assured from the AND gate 60 to prevent operation of the signal absence indicating means 26 so long as the first timer 52 is timing. This deactuating of the signal absence indicating means 26 during transmission by the local transmitter 12 prevents the signal absence indicating means from being responsive to the local transmitter and falsely substituting that response to the intended response from the remote receiver 14. Thus, the periodic actuating signal applying means 30 applies a periodic signal to the transmission absence indicating means 26 to prevent actuation of the transmission absence indicating means during application of the periodic signal.

This avoidance of interference as well as a sufficient delay to allow the remote receiver 14 to establish its signal is provided by the aforementioned second timer 54, the output from which passes through inverter 74 to an AND gate 76 that receives the output from the AND gate 60. Thus, while the second timer 54 is timing with a high signal, it will be inverted to low and applied to the AND gate 76 to produce a low signal while the second timer 54 is timing, thereby preventing actuation of the signal absence indicating means 26, which can only be actuated through AND gates 60 and 76 when the decoder 40 is not on Step 0 and both the first and second timers 52 and 54 have timed out. Thus, the first timer 52 will time out and cause deenergization of the local transmitter and there will be further delay determined by the difference between the timing of the first timer 52 and the second timer 54, which may be, for example, 5 seconds delay, before the signal absence indicating means 26 can respond to a remote transmitter signal. Thus, the periodic actuating signal applying means 30 terminates each periodic signal prior to each sequential stepping by the stepping enabling means 28 for termination of transmission by each local transmitter prior to termination of response by the transmission absence indicating means. This assures quieting down of the local transmitter to avoid interference by transmission from the local transmitters with reception by the local receiver, and the second timer 54, as part of the delaying means 56, assures full establishment of a signal from the remote transmitter before a determination is made by the system whether the remote transmitter is in fact transmitting.

The remote playback unit 20 that responds to the receipt of a signal by the remote receiver 14 requires an extended time period of as much as slightly less than 15 seconds (15 seconds being the time the local transmitter 12 is energized from the Step signal) to develop a sustained signal for activation so that if extraneous signals of lesser duration are received the remote transmitter will not be activated by those extraneous signals. The playback is for 10 seconds or some other set length of time sufficient to establish a signal and maintain it through the time at which the second timer 54 goes from high to low so that the input to AND gate 80 is high and the output will, therefore, be responsive to whether a remote signal is being received or not. The time relation between the first and second timers 52,54 allows the remote signal to be established by receipt of the prolonged local transmitter signal before response because the response occurs when the second timer 54 times out five seconds after the local transmitter 12 is stopped when the first timer 52 times out. This eliminates any interference from the local transmitter in the local receiver and establishes remote transmission or nontransmission before the system responds.

When a remote receiver 14 receives a signal from its associated local transmitter 12, it generates, through its remote transmitter 16, a signal back to its associated local receiver 18 and, similarly, if the remote transmitter 16 is defective or has failed, no signal will be generated and no signal will be received from the local receiver 18, the output of which is applied to an opto-isolator 78, the output from which is low when a signal is being received by the local receiver 18 and is high when no signal is being received by the local receiver 18. This output from the opto-isolator 78 is applied to AND gate 80 that also receives the signal from AND gate 76 which is only high when the decoder 40 is off Step 0 and the second timer 54 has timed out. In this fashion the second timer 54 and associated components serve as means for repetitively applying periodic deactuating signals to the transmission absence indicating means 26. Thus, the only time that the output from AND gate 80 will be high is after the decoder 40 has stepped off Step 0, both timers have timed out and no signal is being received from the remote transmitter.

The output from the AND gate 80 serves as the control signal for the signal absence indicating means 26, which receives a low signal when the local receiver 18 is receiving a signal from the associated remote transmitter 16, which low signal does not activate the signal absence indicating means 26 and the testing system, therefore, does not indicate a failure. However, when the output of AND gate 80 is high, which is when no signal is being received by the local receiver 18 from its associated remote transmitter 16, the high signal is applied as an input to each of the AND gates 82 associated with each latch 48. The other input to each of these AND gates 82 is the signal from the steps of the decoder 40, which signal from the decoder is normally inverted from high to low through the inverter 68 and applied to the AND gate 82 to prevent actuation of the associated latch 48 except when the decoder 40 has stepped to the particular step, at which time, the output is low and inverted to high by the inverter 68 and applied as a high to AND gate 82 to provide with the signal absence indicating high from AND gate 80 a high output from AND gate 82 that is the input to the associated latch 48.

This inverted high from the step is also applied directly to the latch 48. Thus, the latches 48 are responsive sequentially in the same stepping sequence as the relays 72 that activate the local transmitters so as to associate the indication of the absence of a signal with the carrier unit associated with the transmission line with which the particular local transmitter is also associated.

The positive Q output of each latch 48 is connected to an LED 84 that appears on a section 86 of the panel of the tester (FIG. 1) to provide an indication at the local substation, which, if any, transmission line carriers have failed during the testing. Each latch 48 maintains the indication of the absence of a signal throughout subsequent testing of other remote transmitters and until the system 10 is deenergized or the testing is repeated, thereby providing an identification at the end of the testing sequence of the specific remote transmitter from which no transmission was received. The negative $\overline{Q}$ output of the latch 48 is normally high when there is no failure being detected and this high is applied to an 8-input NAND gate 88, the low output from which is inverted by an inverter 90 to a high signal that does not energize a CTF relay 92 connected to the main computer, but when the absence of a signal is responded to by a latch 48, the low output from the negative $\overline{Q}$ terminal of the latch results in a low signal being applied to the CTF relay 92 to provide an indication at the main computer that there has been a failure of at least one carrier during the testing. As each latch 48 remains energized to provide the indication of failure throughout the remainder of testing, the computer will show a failure at the end of testing. Thus, the latches 48 and CTF relay 92 and associated components serve as means to provide a continuing indication when no transmission has been received from at least one of the remote transmitters tested during the testing sequence.

The same signal that is applied to the CTF relay 92 is applied to an AND gate 94 that is part of means 96 responsive to the transmission absence indicating means 26 to prevent deenergizing of the system in response to the absence of a transmission being received from any of the remote transmitters tested during the testing sequence. The low input to this AND gate 94, when a signal absence has been indicated, imposes a low output from the AND gate 94 which, through NAND gate 98 imposes a high signal to the system unlatching relay 100, thus preventing shutdown of the system after any test has been run in which a signal absence detection has been made, in which condition the system will remain energized by relay 100 until it is shut down by an operator at the substation or by a repairman before he services the faulty carrier. Alternatively, the system could be recycled to run another test to verify the failure detected on the first test.

When the system runs through a cycle in which signals are received from all remote carriers, the signal from the multiple NAND gate 88 will be low and inverted to high by the inverter 90, thereby not activating the relay 92 to signal the main computer that a failure has occurred during the testing and also applies the high to the aforementioned AND gate 94 so that the output from AND gate 94 will be controlled by the input received from Step 9 of the decoder 40. When the decoder 40 is not at Step 9, the output will be high and inverted by inverter 102 to low, which low will be the input to AND gate 94, imposing a low output that is the input to NAND gate 98, which will impose a high output and continued energization of relay 100 to maintain the system on. When the decoder 40 steps to Step 9, the output drops to low, which is inverted by inverter 102 to high. This high results in a high output from AND gate 94 when a high is applied to the AND gate 94 from the signal absence indicating means when no signal absence has been detected during a test sequence. This high output from AND gate 94 in an input to NAND gate 98, the other input to which is the inverted signal from the first timer 52, which is a high input to NAND gate 98 only after timer 52 has timed out and its low signal is inverted by inverter 58. When this happens, NAND gate 98 has a low output that is applied to the UL relay 100, thereby opening contact UL/1 to shut down the power-up circuit and turn off the system 10, thereby constituting means for de-energizing the system upon completion of a successful testing sequence.

Thus, at the end of each cycle, when the decoder 40 has reached Step 9, the system will be closed down when no absence of a signal has been detected but will remain powered to continue the indication of the absence of a signal at the computer through relay 92 and an identification of the particular line carrier that failed by the specific LED 84 on the panel section 86, and the system will step to STEP 0, eliminating the indication at the computer that a test is in progress and monitoring the system ready for recycling.

The absence indicating functions carried out at each step occurs after the second timer 54 times out and is completed in the short interval of time created by the capaciters 64 and 66 prior to initiation of the next stepping of the decoder 40 upon the restart of timing by the first timer 52. This provision of a delay in the transmission of the sequencing signal so that the signal absence indicating functions can be carried out allows a simplified integral system to be utilized to advantage. Also, utilizing the last step of the decoder 40 to provide an enabling signal to the shutdown circuitry and also applying an enabling signal upon timing out of the first timer 52 provides a delay at this last step equivalent to the timing of the first timer 52, for example, 15 seconds, sufficient to give the remote transmitter from Step 8 time to stop so that no alarm will be sounded when the system shuts down and the alarm system is thereby reactivated.

So that an observer can note which step the system is on during any particular time of a testing sequence, a seven segment LED display 104 is connected to the counter 38 through a decoder/driver 106. The display 104 appears on the panel along with LEDs 108 and 110 that are responsive to timing of the first timer 52 and second timer 54 respectively. Also, the local start button 32 and an LED 112 indicating that power is on are located on the panel of the system, as illustrated in FIG. 1.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A system for automatically testing the operability of a series of remote, normally quiescent, electrically operable carriers located at diverse remote locations, with each of said remote carriers having an associated local carrier which is adapted to transmit an operability-inquiring electrical signal to its associated remote carrier to cause its associated remote carrier, if it is operable, to transmit, for a predetermined period of time, an operability-indicating electrical signal to its associated local carrier, and with the local carriers being located in general proximity to one another at a single local location, said system comprising:

testing means located at said local location and including:

actuating means associated with each of said local carriers, with each of said actuating means being adapted to selectively actuate its associated local carrier to transmit said operability-inquiring electrical signal to its associated remote carrier;

indicating means associated with each of said local carriers, with each indicating means being adapted to indicate non-receipt by its associated local carrier of said operability-indicating electrical signal from its associated remote carrier within said predetermined peiod of time after the selective actuation of its local carrier by its associated actuating means;

stepping means for enabling all of said actuating means sequentially to cause said actuating means to sequentially actuate all of said local carriers;

de-energizing means for de-energizing said system upon completion of said sequential actuation of all of said local carriers; and de-energizing prevention means responsive to all of said indicating means and being adapted to prevent operation of said de-energizing means in response to an indication by at least one of said indicating means of non-receipt of said operability-indicating electrical signal by at least one of the local carriers from its associated remote carrier.

2. A system for automatically testing the operability of a series of remote, normally quiescent, electrically operable carriers located at diverse remote locations, with each of said remote carriers having an associated local carrier which is adapted to transmit an operability-inquiring electrical signal to its associated remote carrier to cause its associated remote carrier, if it is operable, to transmit, for a predetermined period of time, an operability-indicating electrical signal to its associated local carrier, and with the local carriers being located in general proximity to one another at a single local location, said system comprising:

testing means located at said local location and including:

actuating means associated with each of said local carriers, with each of said actuating means being adapted to selectively actuate its associated local carrier to transmit said operability-inquiring electrical signal to its associated remote carrier;

indicating means associated with each of said local carriers, with each indicating means being adapted to indicate non-receipt by its associated local carrier of said operability-indicating electrical signal from its associated remote carrier within said predetermined period of time after the selective actuation of its local carrier by its associated actuating means;

stepping means for enabling all of said actuating means sequentially to cause said actuating means to sequentially actuate all of said local carriers;

each of said indicating means being adapted to maintain its indication of non-receipt by its associated local carrier of said operability-indicating electrical signal from its associated remote carrier throughout the sequential actuation of all of said local carriers and until the system is de-energized or the sequential actuation is repeated;

de-energizing means for de-energizing said system upon completion of said sequential actuation of all of said local carriers; and de-energizing prevention means responsive to all of said indicating means and being adapted to prevent operation of said de-energizing means in response to an indication by at least one of said indicating means of non-receipt of said operability-indicating electrical signal by at least one of the local carriers from its associated remote carrier.

3. A system for automatically testing the operability of a series of remote, normally quiescent, electrically operable carriers located at diverse remote locations, with each of said remote carriers having an associated local carrier which is adapted to transmit an operability-inquiring electrical signal to its associated remote carrier to cause its associated remote carrier, if it is operable, to transmit, for a predetermined period of time, an operability-indicating electrical signal to its associated local carrier, and with the local carriers being located in general proximity to one another at a single local location, said system comprising:

testing means located at said local location and including:

actuating means associated with each of said local carriers, with each of said actuating means being adapted to selectively actuate its associated local carrier to transmit said operability-inquiring electrical signal to its associated remote carrier;

indicating means associated with each of said local carriers, with each indicating means being adapted to indicate non-receipt by its associated local carrier of said operability-indicating electrical signal from its associated remote carrier within said predetermined period of time after the selective actuation of its local carrier by its associated actuating means;

stepping means for enabling all of said actuating means sequentially to cause said actuating means to sequentially actuate all of said local carriers;

said stepping means being adapted to selectively disable each of said actuation means prior to termination of said predetermined period of time and to selectively sequentially enable all of said indicating means with each of said indicating means being enabled during said predetermined period of time;

delaying means for delaying said enabling of each of said indicating means until after termination of said operability-inquiring electrical signal by the associated local carrier.

4. A system for automatically testing the operability of a series of remote, normally quiescent, electrically operable carriers located at diverse remote locations, with each of said remote carriers having an associated local carrier which is adapted to transmit an operability-inquiring electrical signal to its associated remote carrier to cause its associated remote carrier, if it is operable, to transmit, for a predetermined period of time, an operability-indicating electrical signal to its associated local carrier, and with the local carriers being located in general proximity to one another at a single local location, said system comprising:

testing means located at said local location and including:

actuating means associated with each of said local carriers, with each of said actuating means being adapted to selectively actuate its associated local carrier to transmit said operability-inquiring electrical signal to its associated remote carrier;

indicating means associated with each of said local carriers, with each indicating means being adapted to indicate non-receipt by its associated local carrier of said operability-indicating electrical signal from its associated remote carrier within said predetermined period of time after the selective actuation of its local carrier by its associated actuating means;

stepping means for enabling all of said actuation means sequentially to cause said actuating means to sequentially actuate all of said local carriers;

means for sequentially applying a de-actuating signal to all of said indicating means to prevent enabling of said indicating means during application of said sequentially applied deactuating signals with each of said deactuating signals being applied during the sequential actuation of each of said local carriers and for a period of time extending thereafter to prevent enabling of said indicating means during transmission of said operability-inquiring electrical signal by said local transmitter.

* * * * *

UNITED STATES PATENT OFFICE
CERTIFICATE OF CORRECTION

Patent No. 4,575,710 Dated March 11, 1986

Inventor(s) Martin F. Best

It is certified that error appears in the above-identified patent and that said Letters Patent are hereby corrected as shown below:

Column 4, Line 34, delete "in" and insert therefor — is — .

Column 8, Line 31, delete "from" and insert therefor — by — .

Column 10, Line 7, delete "in" and insert therefor — is — .

Column 11, Line 18, delete "peiod" and insert therefor — period — .

Signed and Sealed this

Eighteenth Day of November, 1986

*Attest:*

DONALD J. QUIGG

*Attesting Officer* *Commissioner of Patents and Trademarks*